US005186578A

United States Patent [19]

Perslow

[11] Patent Number: 5,186,578

[45] Date of Patent: Feb. 16, 1993

[54] WAVE GENERATOR

[75] Inventor: Johan A. Perslow, Huntington Beach, Calif.

[73] Assignee: Space Biospheres Venture, Oracle, Ariz.

[21] Appl. No.: 763,124

[22] Filed: Sep. 20, 1991

[51] Int. Cl.[5] ..... E02B 3/00; E04H 3/18

[52] U.S. Cl. ..... 405/79; 4/491

[58] Field of Search ..... 405/75, 76, 77, 79; 4/491

[56] References Cited

U.S. PATENT DOCUMENTS

| | | | |
|---|---|---|---|
| 4,276,664 | 7/1981 | Baker | 4/491 |
| 4,539,719 | 9/1985 | Schuster et al. | 4/491 |
| 4,812,077 | 3/1989 | Raike | 405/79 |
| 4,999,860 | 3/1991 | Chutter et al. | 4/491 |

FOREIGN PATENT DOCUMENTS

| | | | |
|---|---|---|---|
| 2572775 | 5/1986 | France | 405/79 |
| 161548 | 9/1979 | Netherlands | 405/79 |

*Primary Examiner*—David H. Corbin

*Attorney, Agent, or Firm*—Christie, Parker & Hale

[57] ABSTRACT

Waves are generated on the surface of a body of water, at regular intervals, by a wave generator in which water is periodically lifted and allowed to fall in a water-lift chamber. Water enters and leaves the lift chamber through an underwater opening at its bottom. It is lifted by drawing a vacuum in the top of the lift chamber and dropped by releasing that vacuum. Air is periodically exhausted from the lift chamber to create a vacuum therein by an air blower through an air buffer having a series of interconnected air chambers, to minimize air-pressure fluctuations at the air blower intake. Vacuum in the lift chamber is periodically released by opening it to the atmosphere.

28 Claims, 10 Drawing Sheets

Fig. 8a
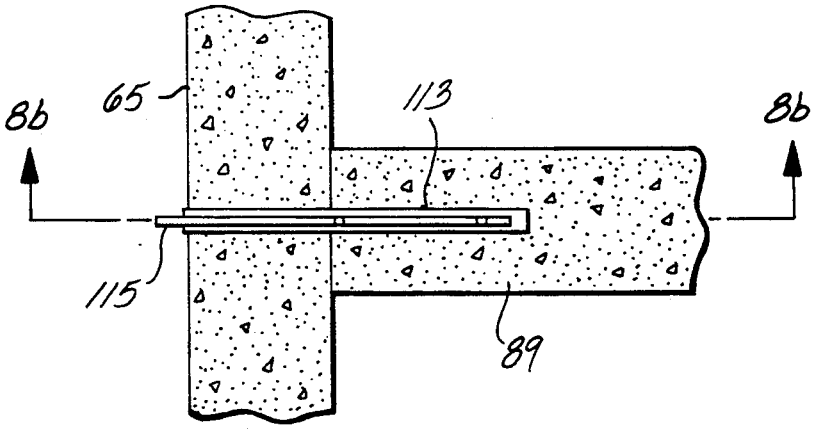
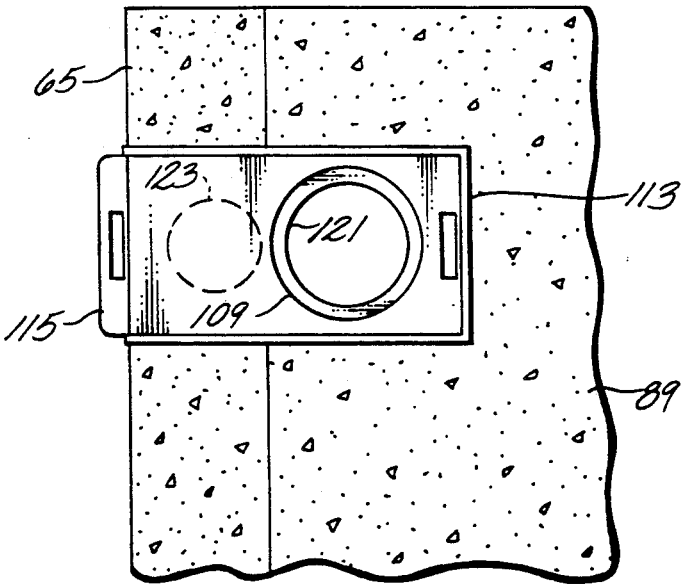
Fig. 8b

WAVE GENERATOR

BACKGROUND OF THE INVENTION

The present invention relates generally to wave generators and, more particularly, to apparatus for creating surface waves in a body of water.

An apparatus for creating a periodic series of waves on the surface of a body of water is described in U.S. Pat. No. 2,056,855, issued to F. K. Hertz on Oct. 6, 1936. The apparatus includes a chamber running adjacent the body of water and an inlet to that chamber, through which water may be exchanged between the chamber and the body of water. Water is drawn into the chamber and is forcibly expelled therefrom by periodically exhausting air from and admitting air under pressure into the chamber. The air pressure required to alternately draw air from and inject air into the water chamber is derived from a single air blower, by means of valves which reverse the flow of air between the blower and the chamber.

Apparatus of the above type is characterized by the fact that there is a direct pneumatic connection between the chamber holding the water and the blower used to exhaust air from and inject air into that chamber. Foremost among the disadvantages of such apparatus is the extreme fluctuation in loads imposed on the blower by the periodic reversal of air flow and the continual extremes of air pressure resulting therefrom. Not only does the periodic reversal of air flow under pressure subject the apparatus to excessive shock and wear, it also requires the valves and the conduits though which air flows, to be constructed more robustly than would otherwise be necessary. Accordingly, it is a principal object of the present invention to provide a wave-making apparatus whereby surface waves are induced by means of an air blower on which load fluctuations are held at a minimum, thereby increasing its life and effectiveness.

BRIEF DESCRIPTION OF THE INVENTION

In accordance with the invention, there is provided a wave generator which includes a water elevator positioned next to a body of water, a blower for exhausting air, and an air buffer connected between the blower and the water elevator. More specifically, the water elevator includes a water-lift chamber rising above the surface of the body of water, an opening extending below the surface of the body of water for exchanging water between it and the chamber, and air inlets and outlets respectively for admitting air into and exhausting air from the water-lift chamber. Connected between the blower and the water-lift chamber air outlet is an air buffer, through which air is drawn by the blower from the chamber. Valves periodically open and close the air inlet and air outlet of the water-lift chamber so that, when the air inlet is closed and the air outlet is open, water is raised in the water-lift chamber, and so that, when the air outlet is closed and the air inlet is opened, water drops in the chamber and is expelled therefrom through its underwater opening, inducing a wave along the surface of the body of water.

Advantageously, the blower operates continually and pressure fluctuations, which tend to be induced by the periodic opening and closing of the valves, are smoothed out by the air buffer before they reach the blower. Toward this end, the buffer between the blower and the water-lift chamber preferably comprises a plurality of interconnected air chambers, the air chambers being separated by partitions having openings therein to allow controlled flow of air between adjacent chambers. In one such arrangement, the air buffer includes a first air chamber pneumatically connected to the air intake, a last air chamber pneumatically connected to the water-lift-chamber air outlet, and at least one intermediate air chamber pneumatically connected between the first and last air chambers through the aforementioned openings in the inter-chamber partitions.

To permit fine-tuning of the air buffer, means may be additionally provided for altering the size of the partition openings among predetermined values, thereby altering the pneumatic characteristics of the air buffer. Such means may advantageously include a panel with at least one orifice therein that is smaller than the opening in the partition, and means for affixing the panel to the partition so as to superimpose the orifice upon the opening, thereby effectively reducing the size of the opening to that of the orifice. Optionally, such a panel may include a plurality of differently-sized orifices, each of which is smaller than the opening, the panel being slidable upon the partition so as to superimpose a selected one of the orifices upon the partition opening.

While the air buffer may be entirely separate from the water elevator, it may be arranged to extend along one side thereof and may share a wall therewith. In such an arrangement, the water-lift chamber extends linearly along the surface of the body of water, and the air buffer comprises an integral structure having external walls forming a linearly-extending, sealed air space immediately adjacent the water-lift chamber. In such an arrangement, the partitions which separate the sealed air space into a plurality of serially interconnected chambers may also serve as a structural reinforcement, to resist collapse of the structure due to the air pressure differential to which it is subjected when air is exhausted from the chambers within.

BRIEF DESCRIPTION OF THE DRAWINGS

These features and advantages of the invention, as well as other features and advantages of the invention, will be more apparent from a reading of the claims and of the detailed description of the invention in conjunction with the drawings described below.

FIGS. 8A and 8B are enlarged views of the partitions and adjustable openings therein shown in FIGS. 6 and 7;

DETAILED DESCRIPTION

Figure 1:
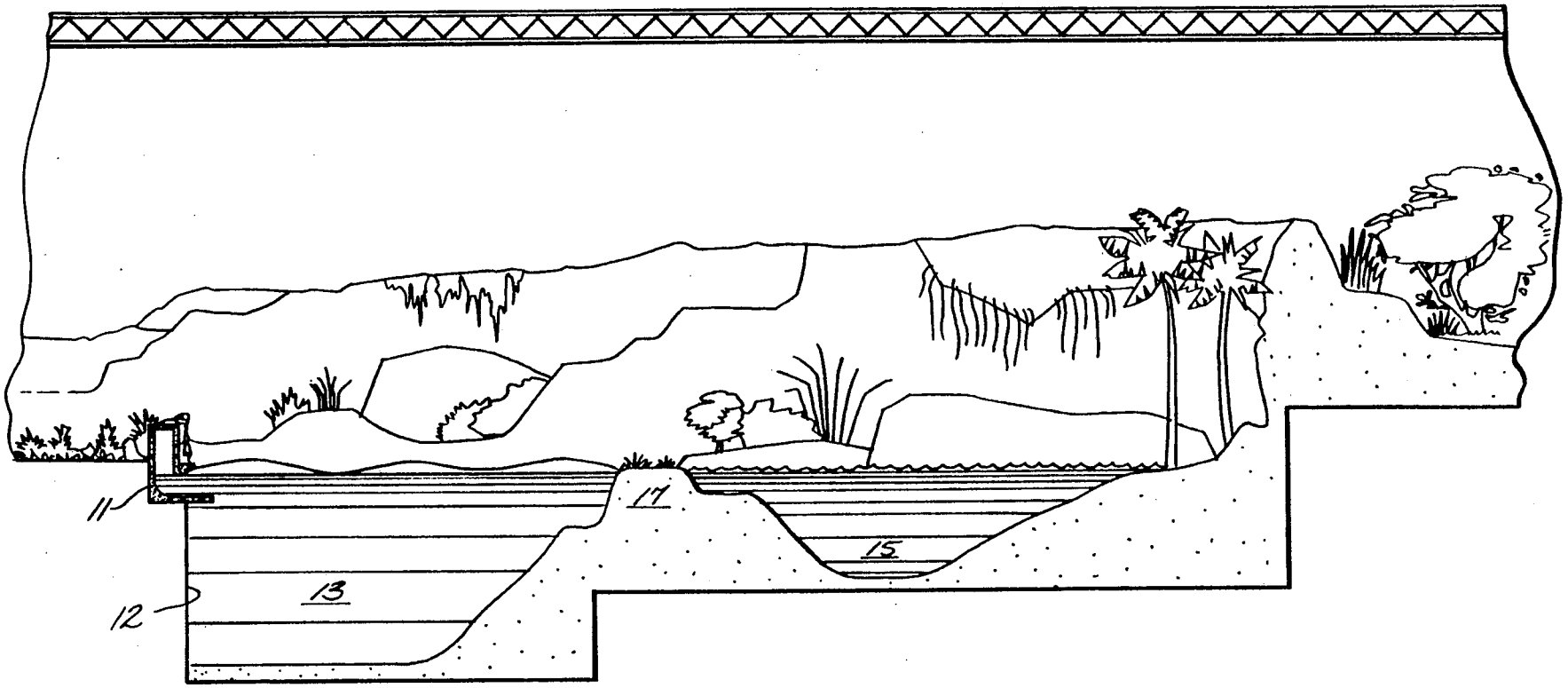
FIG. 1 is a cross-section through a man-made basin containing a body of water, at the edge of which is located a wave generator incorporating the present invention.

FIG. 1 illustrates a wave generator 11 installed adjacent an edge of a man-made basin 12 defining a body of water. Although the body of water may be of an even depth, in the illustrated embodiment it is divided into a deep "ocean" region 13 and a shallower "lagoon" region 15 by an intervening reef 17. Waves induced along the surface of the ocean region 13 by the wave generator 11 are propagated along the surface of that region and may spill over the reef 17 and continue beyond, into the lagoon region 15.

Figure 2:
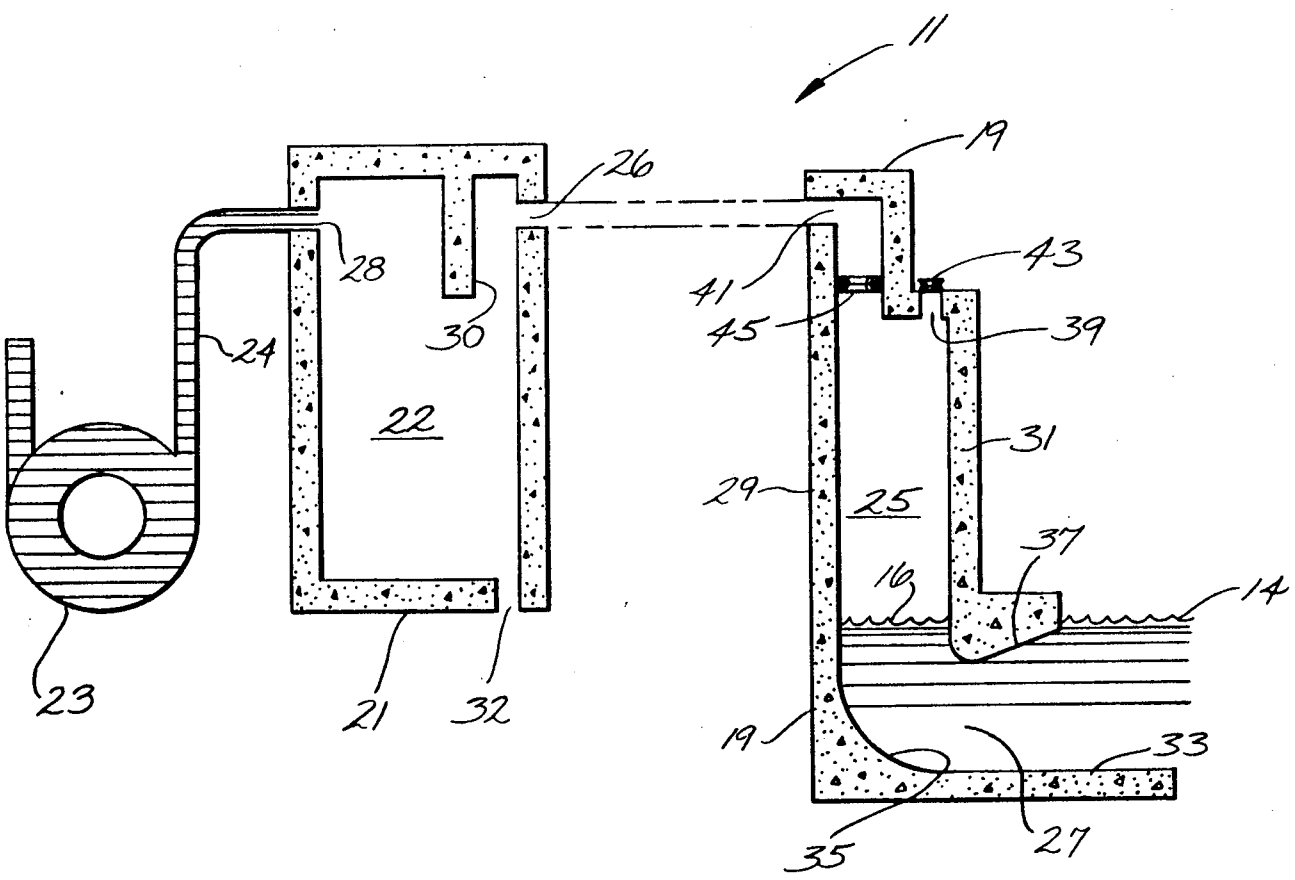
FIG. 2 is a schematic representation of a wave generator, wherein a single air chamber is interposed between a vacuum blower and a water elevator.

As seen in greater detail in FIG. 2, the wave generator 11 comprises a water elevator 19, an air buffer 21, and a blower 23 having an intake 24. The air buffer 21 comprises a single air chamber 22 having an air outlet 28 connected to the blower intake 24; an air intake 26 coupled to the water elevator 19; and a baffle 30, between the air intake 26 and outlet 28, to deflect water which might be sucked into the blower 23 from the water elevator 19. Water entering the chamber 22 and deflected by the baffle 30 is removed through a drain 32 in the floor of the chamber.

The water elevator 19 comprises a water-lift chamber 25 which rises above the surface 14 of the body of water, and a discharge opening 27 extending below the water surface 14. The water-lift chamber 25 is formed by a pair of upright walls—rear wall 29 and front wall 31—the rear wall transitioning into a floor 33, preferably through a smooth, curved region 35. The front wall 31 terminates in an upwardly-curved lip 37, contoured to cause water to be thrust, both outwardly and upwardly, so as to create a well-formed wave when expelled from the water-lift chamber 25 through the discharge opening 27. Air is drawn from the atmosphere into the water-lift chamber 25 through an air inlet 39, and is exhausted from that chamber through an air outlet 41, which is connected to the air buffer inlet 26. Means in the form of valves 43 and 45, respectively across the inlet 39 and outlet 41, serve to periodically open and close them, causing water in the water-lift chamber 25 periodically to rise and fall under the influence of the blower 23.

Figures 3A, 3B, 3C, 3D:
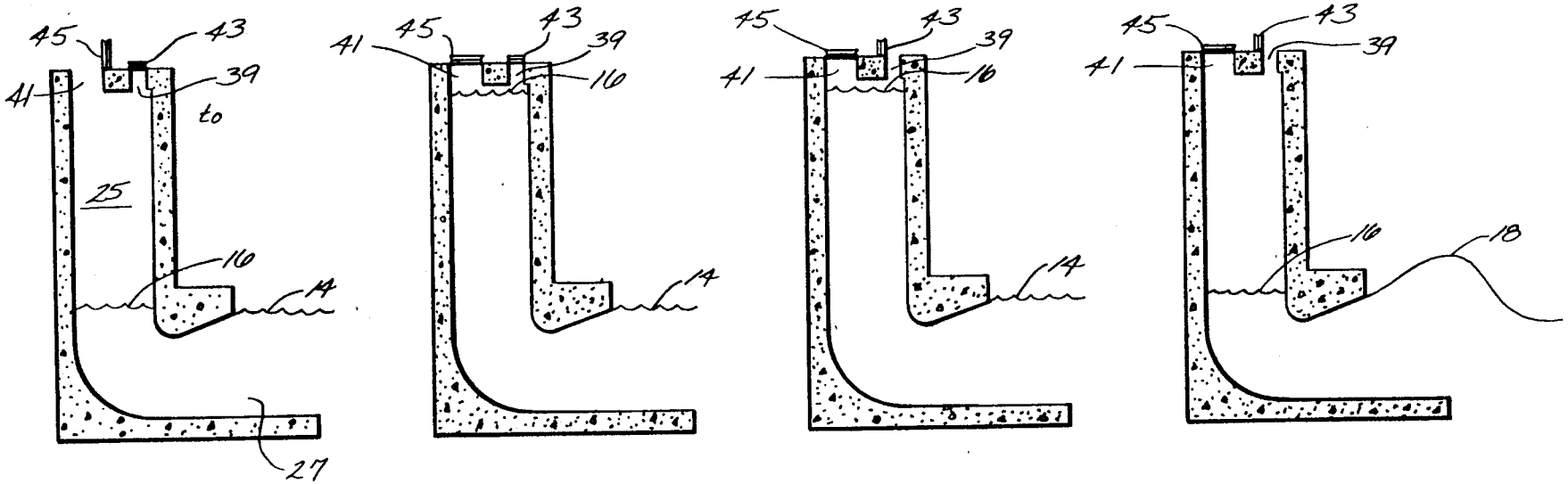
FIGS. 3A–3D illustrate a cycle of the apparatus shown in FIG. 2, during which water is lifted in the water elevator and then allowed to drop, of its own weight, to create a wave.

Operation of the wave generator 11 schematically illustrated in FIG. 2 may be best understood with reference both to FIG. 2 and to FIGS. 3A-3D. With the blower 23 continually operating, air is continually being removed from the air chamber 22. The water-lift cycle is begun by closing the valve 43 and opening the valve 45 (FIG. 3A). This will cause air to rush from the top of the water-lift chamber 25 into the air chamber 22, wherein air pressure has been drawn down to a partial vacuum by the blower 23. The water level 16 inside the water-lift chamber 25 rises until it reaches a predetermined position, shown in FIG. 3B, at which point the valve 45 is closed, marking completion of the water-lift portion of the cycle. The valve 43 is then opened (FIG. 3C), allowing air to be admitted into the water-lift chamber 25 through the air inlet 39. The column of water in the water-lift chamber 25 is thus allowed to fall, expelling water through the discharge opening 27, creating a wave as the water column nears the bottom of the chamber, as seen in FIG. 3D.

During the period that the valves 43 and 45 are respectively open and closed, as shown in FIGS. 3C and 3D, the air pressure in the buffer air chamber 22, which had risen during the lift portion of the cycle shown in FIG. 3A, gradually drops, due to the continual action of the blower 23 so that, when the cycle returns to the phase shown in FIG. 3A, wherein the valves 43 and 45 are respectively closed and opened, the air pressure within the chamber 22 will have returned to its minimum.

In the absence of the buffer 21, air would have to be exhausted from the water-lift chamber 25 directly by the blower 23. Not only would there be the risk of water splashing into the blower intake 24, but the load on the blower would be drastically altered each time the valve 45 was opened. Furthermore, the capacity of the blower would have to be increased to handle the air flow rate requirement necessary to exhaust the required amount of air from the water-lift chamber 25 within the time required to complete the cycle illustrated in FIG. 3. Typically, such a cycle may take less than 10 seconds. Provision of the air buffer 21 allows the blower 23 to continually operate and to build up a "reserve" of vacuum in the chamber 22 during the "fall" intervals (shown in FIGS. 3C and 3D) between the "lift" periods (shown in FIG. 3A) during which air is being drawn from the water-lift chamber 25.

Figure 4:
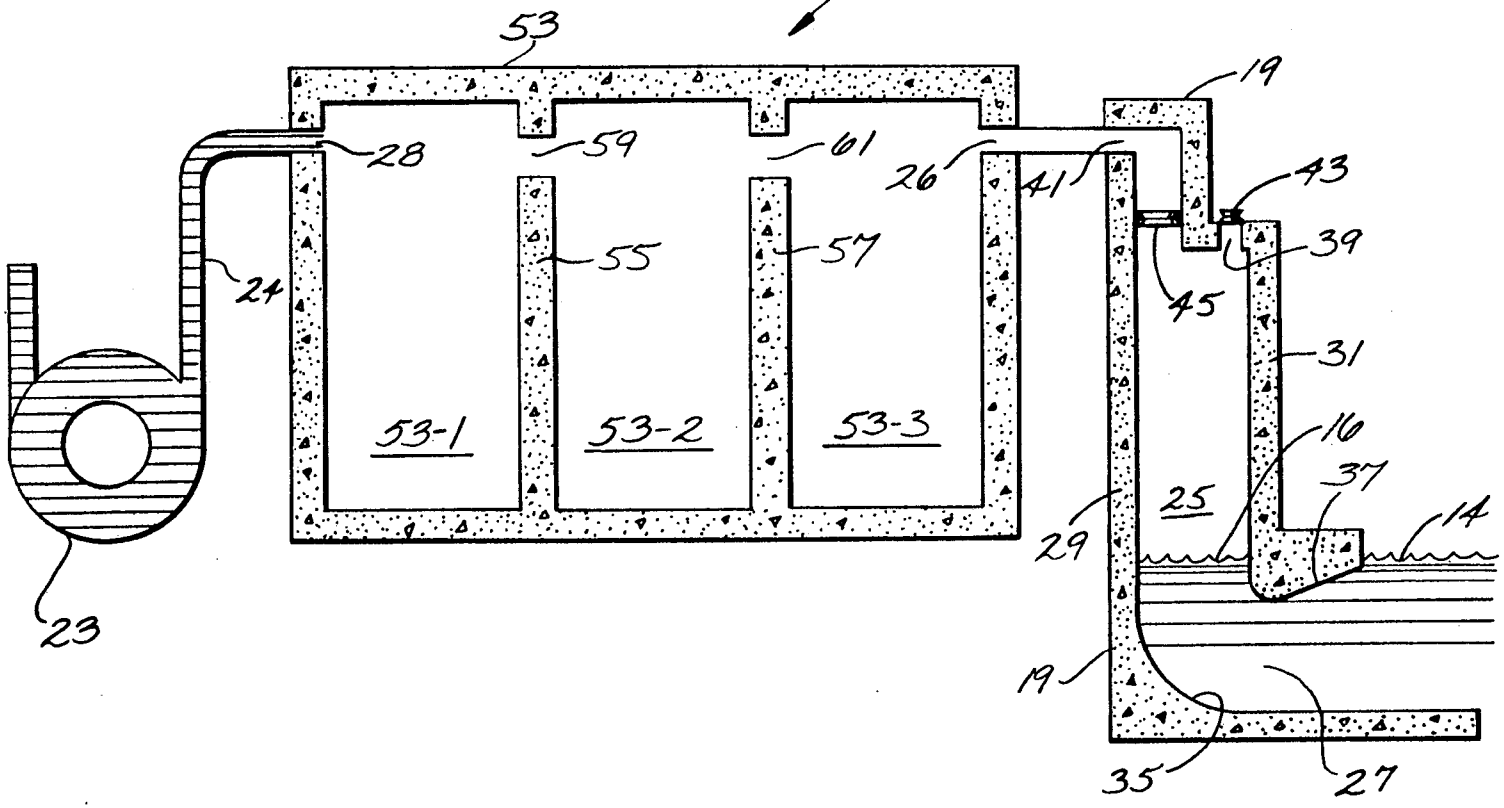
FIG. 4 illustrates an apparatus similar to that of FIG. 2, wherein a multi-chamber air buffer is interposed between the water elevator and the blower.

A further improvement in wave generators is illustrated in FIG. 4, wherein the improved wave generator 51 comprises the blower 23 and the water elevator 19 illustrated in FIG. 2, coupled through a multi-chamber air buffer 53. The air buffer is divided into three equally-sized chambers 53-1, 53-2, and 53-3 by means of partitions 55 and 57, respective ones of which include openings 59 and 61 to establish communication between adjacent ones of the chambers 53-1 through 53-3. Preferably, each of the chambers has a volume which is substantially equal to that of the water-lift chamber 25.

The multi-chamber air buffer of FIG. 4 represents a marked improvement over the single-chamber air buffer of FIG. 2 in two respects. First, the likelihood of any water from the water-lift chamber 25 getting into the blower intake 24 is greatly reduced. Second, the air pressure fluctuations at the blower intake 28, caused by the periodic opening and closing of the valves 43 and 45, are significantly reduced, even below the levels permitted by the arrangement of FIG. 2. The following discussion of the air pressures prevailing in the chambers 53-1, 53-2, and 53-3 will reveal why this is so.

An operating cycle of the water elevator 19 will be examined beginning with the instant, depicted in FIG. 3A, when the water level 16 has just dropped to its lowest point. The valve 43 has just been closed, and the valve 45 has just been opened. At this instant, just before air begins to be drawn from the water-lift chamber 25 into the last air chamber 53-3, the pressures in the three air chambers 53-1, 53-2, and 53-3 will have nearly equalized as a result of the action of the blower 23 and the flow of air between the air chambers during the preceding "rise" and "fall" cycles, depicted in FIGS. 3A-3D. Since the valve 43 to the atmosphere has just closed and the valve 45 has just opened, the pressure in the water-lift chamber 25 this time is atmospheric, or zero. As air begins to rush from the water-lift chamber 25 into the last air chamber 53-3, the pressures within the two chambers approach (but do not totally reach) equality, since their volumes are substantially equal.

The exact amount of pressure (or vacuum) in the air chambers will vary with the height of the water column to be created in the water-lift chamber 25. The following analysis will be based on the dimensions of the system shown in greater detail in FIGS. 5-10, wherein a column of water rises and falls over an approximately 5-ft. range. In that event, the pressure in the chambers 53-1, 53-2, and 53-3 will be brought down to equalize at a vacuum of about 7, 6½, and 6 ft. respectively. In talking of vacuum in the various chambers of the air buffer 53, a unit of feet of water shall be used. Thus, a vacuum of 5 ft. of water is the amount of pressure below atmospheric which will support a column of water 5 ft. high.

Assuming an initial vacuum of 7, 6½ and 6 ft. of water in the chambers 53-1, 53-2, and 53-3, just before the valve 45 opens, the vacuum in the last air chamber 53-3 will almost instantly drop (and the air pressure will rise) from 8 ft. to 4 ft. as air rushes into the last chamber 53-3 from the water-lift chamber 25. This drop in vacuum (and rise in pressure) in the last chamber 53-3 will induce air to flow through the opening 61 from that chamber into the middle chamber 53-2, causing its vacuum to diminish (and pressure to rise), much more moderately, to about 8 ft. of water, than that of the last chamber 53-3. The same effect ripples through, only minimally, to the first air chamber 53-1. Accordingly, a very short time after the above events are initiated—on the order of 3/10 of a second after the opening of the valve 45—the air pressures in the chambers 53-3, 53-2, and 53-1 have moderated to vacuums of 3 ft., 5 ft., and 7 ft. (the latter remaining essentially unchanged).

As time passes and water is being lifted in the elevator 19 (this period in time occurring between the instants depicted in FIGS. 3A and 3B), the vacuum in chamber 53-3 gradually recovers (i.e., the air pressure in the last chamber 53-3 gradually drops), as air is drawn through the opening 61 into the middle chamber 53-2 from the last chamber 53-3, faster than it is being drawn into that chamber from the water-lift chamber 25. Since air is not drawn from the middle chamber 53-2 into the first chamber 53-1 as rapidly as it is being drawn into the middle chamber 53-2 from the last chamber 53-3, the air pressure in the middle chamber 53-2 begins to rise (and vacuum begins to drop). During the same period as described, air is being drawn from the middle chamber 53-2, through the opening 59, into the first air chamber 53-1, slightly faster than it is being drawn from the first chamber 53-1 into the blower intake 24, through the opening 28. As a result, the air pressure in the chamber 53-1 rises slightly (and the vacuum therein drops slightly). For the maximum wave height of 2 feet, for the disclosed apparatus is designed, by the end of the "lift" time period between the instants depicted in FIGS. 3A and 3B, approximately 7 seconds after the opening of the valve 45, the air-pressure distribution in the chambers of the buffer 53 will be such that the vacuum in the last chamber 53-3 will have recovered to about 5 ft. of water, that in the middle chamber 53-2 will have fallen to about 6 ft. of water, and that in the first chamber 53-1 will have dropped to about 6½ ft. of water.

During the following brief, approximately 1.5 seconds, "fall" period (FIGS. 3C, 3D), when the valve 45 is closed, the recovery of vacuum in the chambers 53-1, 53-2, and 53-3 is completed, returning them to their initial levels of about 7, 6½, and 6 ft. of water, respectively.

It should be apparent that the multiple-air-chamber arrangement of FIG. 4 enjoys a significant advantage over the single-air-chamber arrangement of FIG. 2. Were the first and second air chambers 53-1 and 53-2 to be omitted, so as to convert the FIG. 4 system to that of FIG. 2, the substantial air-pressure drop, from 9 to 4 ft. of water, in the chamber 53-3 would have been directly applied to and felt by the blower 23. Of course, if the air buffer between the blower and the water-lift chamber 25 had been completely omitted, the change would have been even more drastic, since the air pressure sensed by the blower at its intake would have suddenly jumped to essentially no vacuum at all. Thus, interposing even a single-chambered buffer, as in FIG. 2, represents an improvement over its absence. The further improvement effected by the multi-chambered buffer 53 is significant in that it reduces the air pressure fluctuation at the blower intake 24 from that seen to occur in the last air chamber 53-3 to that which was seen to take place in the first air chamber 53-1. Accordingly, rather than a vacuum fluctuation between 7 ft of water and 3 ft. of water, as might have been expected with a single-chamber buffer, such as in FIG. 2, the air pressure fluctuation at the blower intake 24 has been reduced to that between 7 and 6 ft. of water, in the case of the arrangement of FIG. 4.

Because the air pressure in the first chamber 53-1 fluctuates only slightly (by about 1 ft.), the air blower 23 is able to work at a constant pressure and at a substantially steady volume, resulting in substantially less strain. Furthermore, by being able to work the air blower at a steady pace, its size may be reduced, because it is operating at a higher pressure than it would were its intake pressure fluctuating over a wide range.

Figure 5:
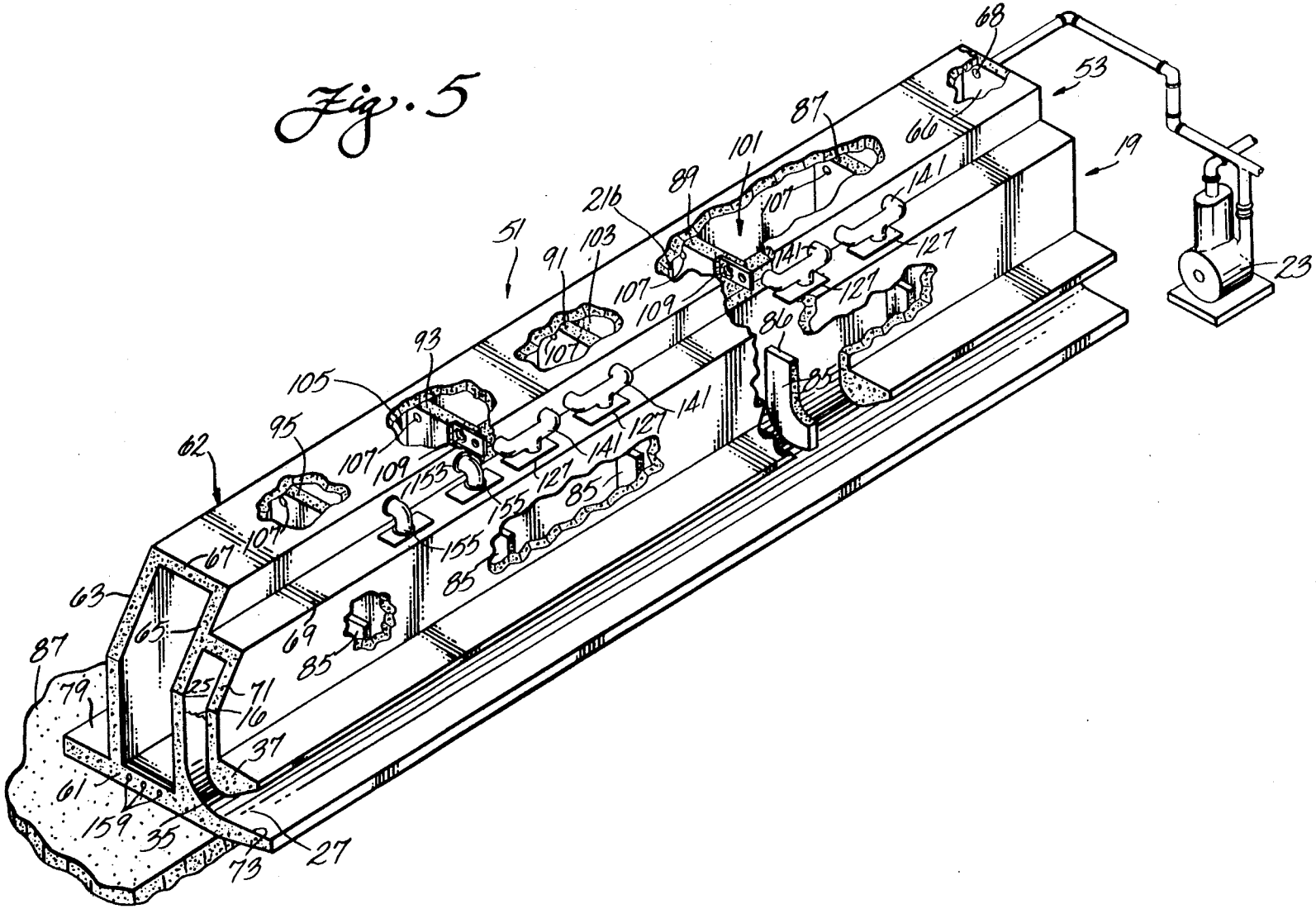
FIG. 5 is a perspective view of the preferred embodiment shown schematically in FIG. 4, wherein the air buffer is structurally integrated with and adjacent to the water elevator.
Figure 6:
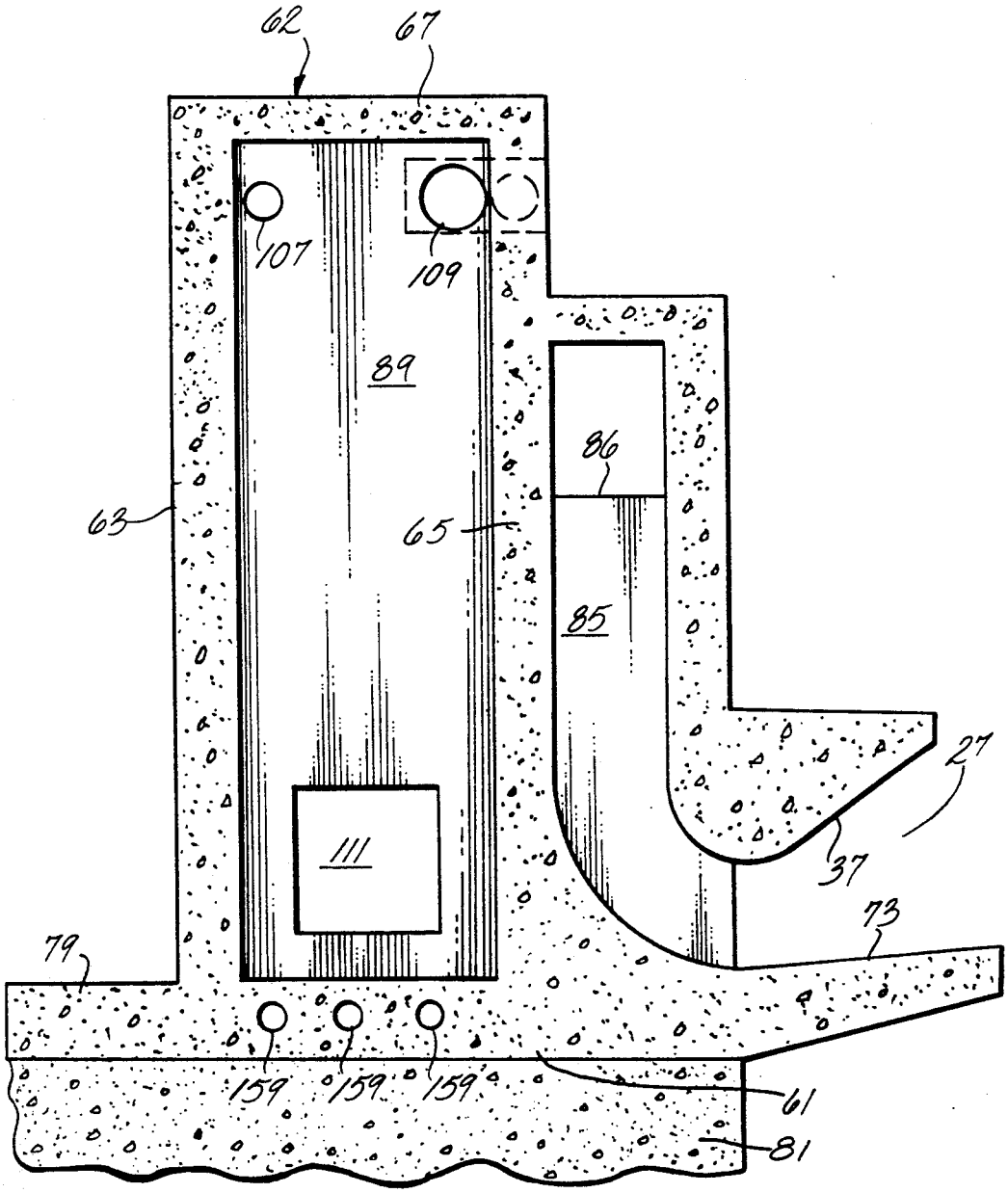
FIG. 6 is a cross-section through FIG. 5 showing the partitions forming the multiple-air-chamber arrangement.

FIGS. 5 and 6 illustrate a preferred embodiment of the multi-air-chamber wave generator 51 schematically illustrated in FIG. 4. The wave generator 51 of FIGS. 5 and 6 represents a specific, carefully-engineered version of the FIG. 4 wave generator, which will be described in considerable detail, including dimensions, in order to convey to the reader the scope and relative proportions of a practical implementation of the invention contemplated by the inventor. It should be understood that the dimensions given are in no way meant to be limiting and could readily be changed to accommodate different performance requirements and circumstances. The particular embodiment to be described was designed to generate a series of waves, about 1.5 ft., peak-to-trough, with a mean period of about 9½ seconds, in a body of water such as that illustrated in FIG. 1, wherein the depth of the ocean region 13, in which the waves are introduced, is about 30 ft., and the width of that region (in a direction extending into the plane of the vapor) is about 60 ft.

The wave generator 51 is a large, unitary, steel-reinforced, concrete structure having a base 61 which forms the floor of a long conduit 62 of rectangular cross-section having a rear wall 63, a front wall 65, near and far end walls 66 (of which only the far one is shown), and a roof 67. The conduit 62 forms the outer walls of the multi-chamber air buffer 53. The blower 23 draws air from the conduit 62 through an opening 68 in its rear end wall 66. In the particular embodiment shown, two Hoffman Model 38306C blowers are used, one of them on standby, each driven by a 40 H. P. Toshiba OPP motor and capable of evacuating 860 standard cubic feet per minute (scfm) at a vacuum of 7 feet of water. It is believed that, with all three blowers operating, the rate of air evacuation from the water-lift chamber 25 to be described, will support a 5-ft.-high water column lift in that chamber which, in turn, can generate a wave 2-ft. high, peak-to-trough. The target wave of 1.5 ft. is believed to be achievable by operating only one of the two blowers.

Cantilevered horizontally-forward from the front wall 65, from a point below the roof 67, is a ledge 69 (forming the roof of the water-lift chamber 25) from which there extends downwardly, and parallel to the front wall 65, a vertical panel 71 (forming the front wall of the chamber 25), terminating in a forwardly-extending upper lip 73. The base 61 extends forwardly to form a lower lip 75, which protrudes just beyond the upper lip 73 and which, with that lip, forms a water-discharge opening 77. To help balance the structure, a rear member 79 extends from the base 61 in a direction opposite that of the lower lip 75. The entire structure 51 rests on a concrete pad 81, stands about 12 ft. high, and is about 60 ft. long.

As best seen in FIG. 6, the inner surfaces of the lips 73 and 75 are both upwardly curved, the upper lip more so than the lower lip, in order to provide the proper discharge contour for water to be ejected through the opening 77. The wall 65, ledge 69, and panel 71 define the water-lift chamber 25, having a cross-section in the shape of an inverted "U", into which water is drawn through the opening 27 from the body of water next to which the wave generator 51 is positioned, under the influence of a vacuum which is periodically drawn in the portion of the water-lift chamber 25 above the water level 16 therein. The periodic raising and dropping of water in the water-lift chamber 25 imposes substantial stress upon the cantilevered ledge 71. To prevent failure of that member, reinforcing panels 85 are installed at intervals in the water-lift chamber 25, the panels extending between, and anchored to, the wall 65 and the ledge 71. Each of the reinforcing panels 85 terminates in an upper edge 86, which is spaced from the ledge 69 forming the roof of the water-lift chamber 25, so as to provide a single, unitary air space below the ledge 69 shared by the entire water-lift chamber 25.

Positioned in line with the five reinforcing panels 85 are five vertical panels 87, 89, 91, 93, and 95 in the conduit 62. Each of the panels 87–95 serves to reinforce the conduit 62 formed by the base 61, roof 67, and walls 63 and 65. Two of them, the panels 89 and 93 (which hereinafter shall be referred to as "partitions"), serve the additional purpose of dividing the space defined by the conduit 62 into three, equally-sized chambers 101, 103, and 105. Those chambers correspond respectively to the chambers 53-1, 53-2, and 53-3 of FIG. 4 and are about 19 ft. long, about 3¼ ft. wide, and about 10½ ft. high, or about 650 cubic ft. In comparison, the water-lift chamber is about 57 ft. long, 1.5 ft. wide, and 6.5 ft. high, from the top of the throat of its discharge opening 77 to its roof 67, for a total volume of about 560 cubic ft., which is comparable to the volume of one of the chambers 53-1, 53-2, and 53-3. The discharge opening 27 is about 16 inches across its throat, widening to about 3 ft. across its mouth.

The chambers 101, 103, and 105 are pneumatically interconnected (i.e., for conduction of air) through two sets of openings in each of the partitions 89 and 93. The first opening 107 is located in the upper left-hand corner (as viewed in FIGS. 5 and 6), and in the exemplary embodiment, is 6 inches in diameter. Such an opening 107 is located also in each of the other three panels 87, 91, and 95. A second opening 109 is located in each of the partitions 89 and 93 and is absent from the other panels 87, 91, and 95. As will be described with reference to FIGS. 7, 8A, and 8B, the second set of openings 109 are adjustable in size by means of sliding panels containing orifices that are superimposed on the openings 109, each of which in the illustrated embodiment is 10 inches in diameter.

Because the panels 87, 91, and 95 are only for structural reinforcement, and not to provide a partition in the manner of the partitions 89 and 93, each of the three panels 87, 91, and 95 is provided with a large (typically, 22 inches square) opening 111 near its base (FIG. 6). By virtue of the large, rectangular openings 111, which provide essentially unrestricted air flow through the panels 87, 91, and 95, the role of those panels is limited to that of structural reinforcement, and they do not affect the air pressure prevailing in the chambers 101, 103, and 105. For sake of uniformity, to aid in fabricating the panels 87, 89, 91, 93, and 95, all of them may be identical, including the rectangular openings 111, although they are desired in only the three panels 87, 91, and 95. In the other two partitions 89 and 93, which are to serve as partitions to define adjacent air chambers, the openings are simply blocked by plastic (typically, PVC) plates which are bolted onto the panels.

Figure 7:
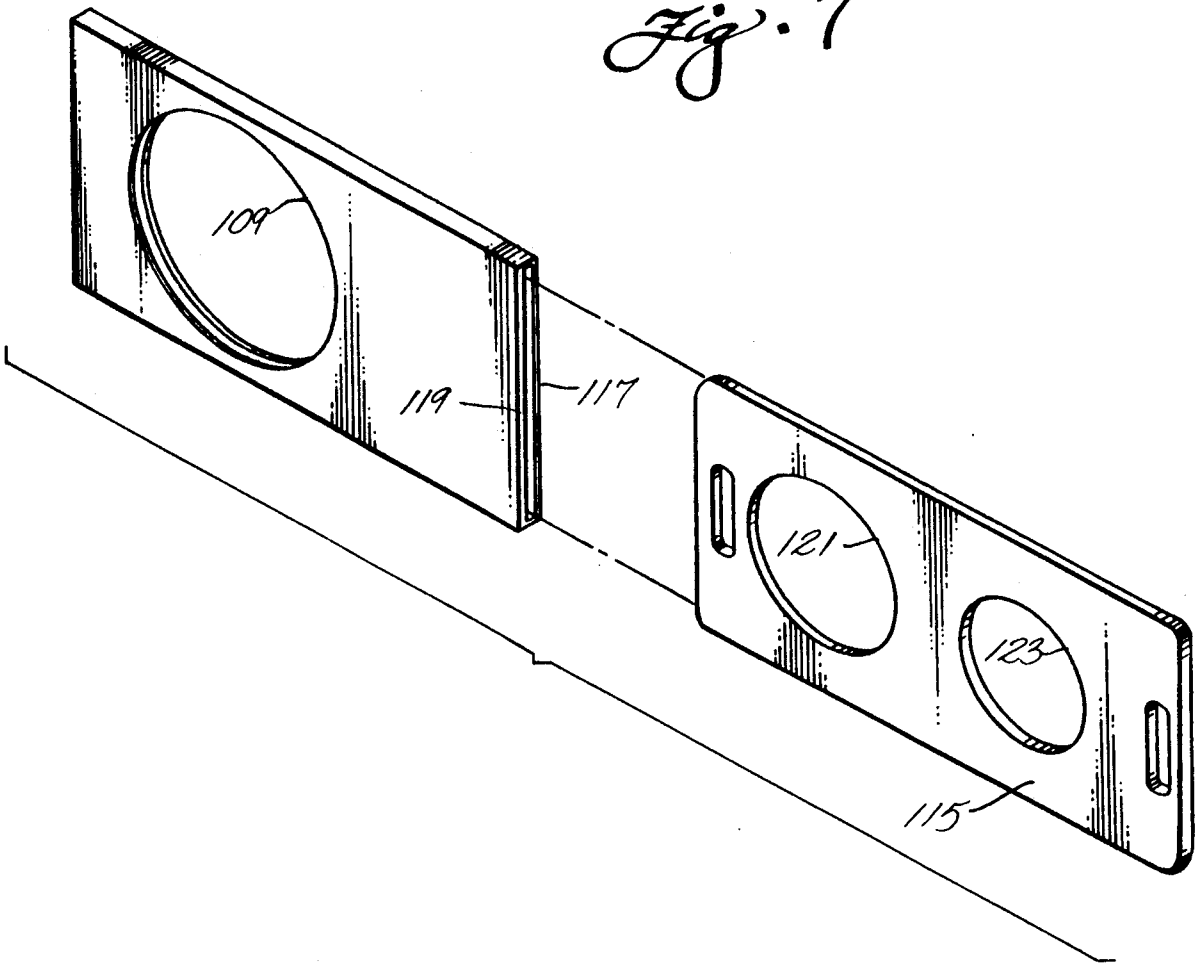
FIG. 7 is a perspective view of an adjustable opening in one of the partitions shown in FIG. 6.
Figure 9:
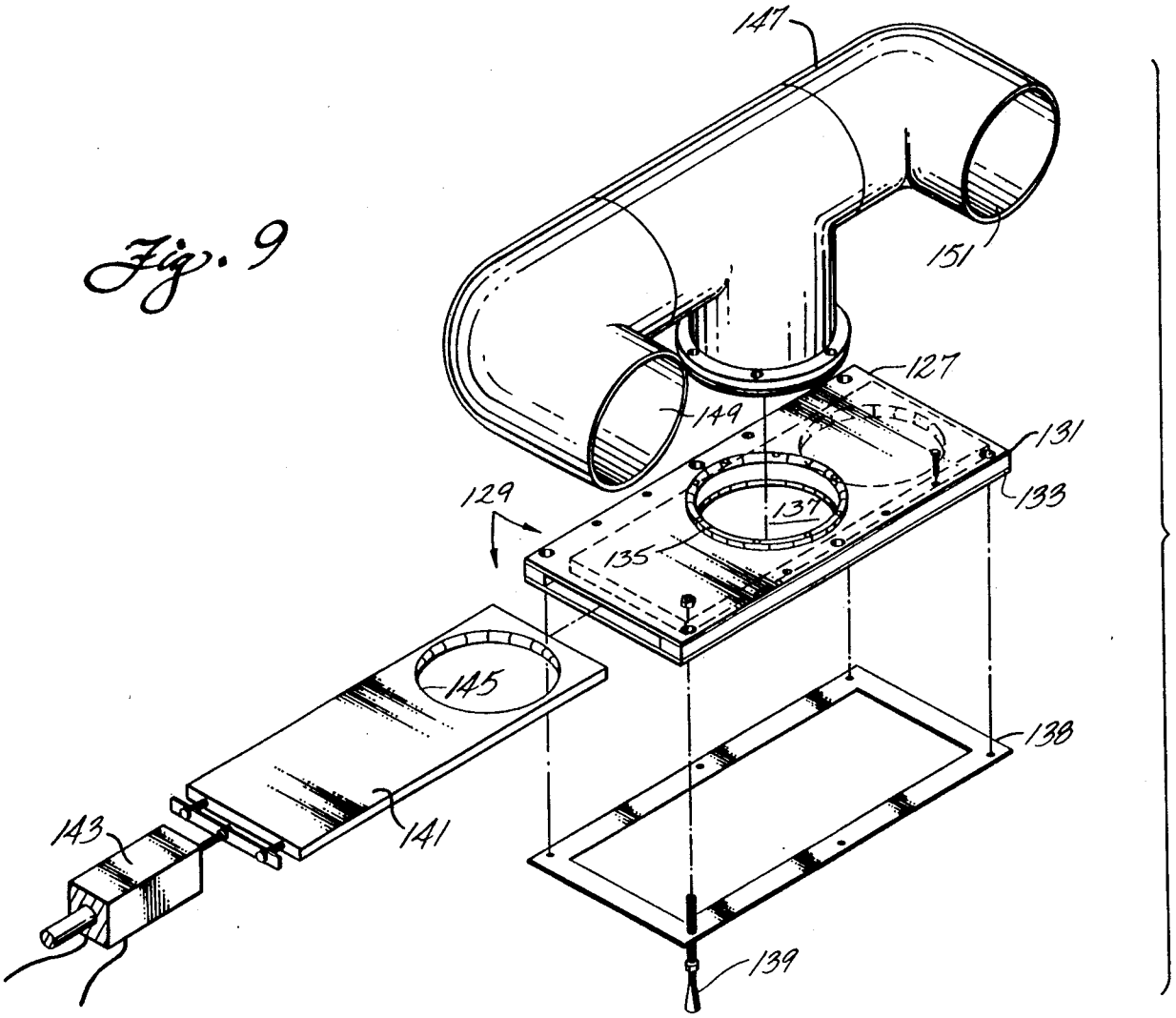
FIG. 9 is an exploded, perspective view of one of the air inlets to the water-lift chamber illustrated in FIG. 5 and a valve for periodically opening and closing that inlet.

The adjustable openings 109 are preferably formed by means of plastic inserts, shown in FIG. 7, comprising a housing 113 and a slide 115 insertable therein. The housing 113 may be in the form of a rectangular, PVC sheath having parallel walls 117 and 119, in which the opening 109 is formed The slide 115 comprises a PVC panel containing a pair of orifices 121 and 123, each of which is smaller than the opening 109. The housing 113 is cast in place in the respective partitions 89 and 93, as shown in FIG. 5 and in greater detail in FIGS. 8A and 8B. The size of the openings 109 may be adjusted among three sizes: the largest, when the slide 115 is entirely removed, and two progressively-smaller sizes, when the slide is in place, with one or the other of its orifices 121 and 123 superimposed on the opening 109.

There have been described thus far, with reference to FIGS. 5–8, the three interconnected air chambers 101, 103, and 105 separated by the partitions 89 and 93, having adjustable openings 109 and fixed openings 107 therein, and the water-lift chamber 25 in which a column of water is raised and lowered. Air is drawn from the first chamber 87 (corresponding to the chamber 53-1 in FIG. 4), through the opening 68 in the far end wall 66, by means of the blower 23. Next, there will be described the manner in which air enters the water-lift chamber 25 from the atmosphere and is drawn from that chamber into the last air chamber 105, in the manner described previously in general with reference to FIG. 4. A set of four rectangular inlets (not shown) are provided in spaced-apart relationship in the ledge 69. Bolted to each of those inlets is the frame 127 of a valve assembly 129, illustrated in FIG. 9. The valve frame 127 includes a pair of spaced-apart, stainless-steel panels 131 and 133, each having an opening therein, the openings in the two panels being joined by a stainless-steel collar 135 to define an inlet 137. The valve frame is held in place on the ledge 69 by anchoring bolts 139, there being a rectangular gasket 138 sandwiched between the valve frame and the ledge 69.

An apertured slide 141, preferably of Delrin, is mounted for linear movement between the valve panels 131 and 133 by means of a stepper motor 143. An opening 145 in the slide 141 matches the inlet 137. When the slide is in a first position, the openings 137 and 145 line up and the valve is open, and when the slide is in a second position, shown in dashed lines in FIG. 9, the inlet 137 is completely covered by the solid portion of the slide 141 and the valve is closed. Bolted on top of the valve assembly 129 is an air intake manifold 147 having first and second intakes 149 and 151.

Figure 10:
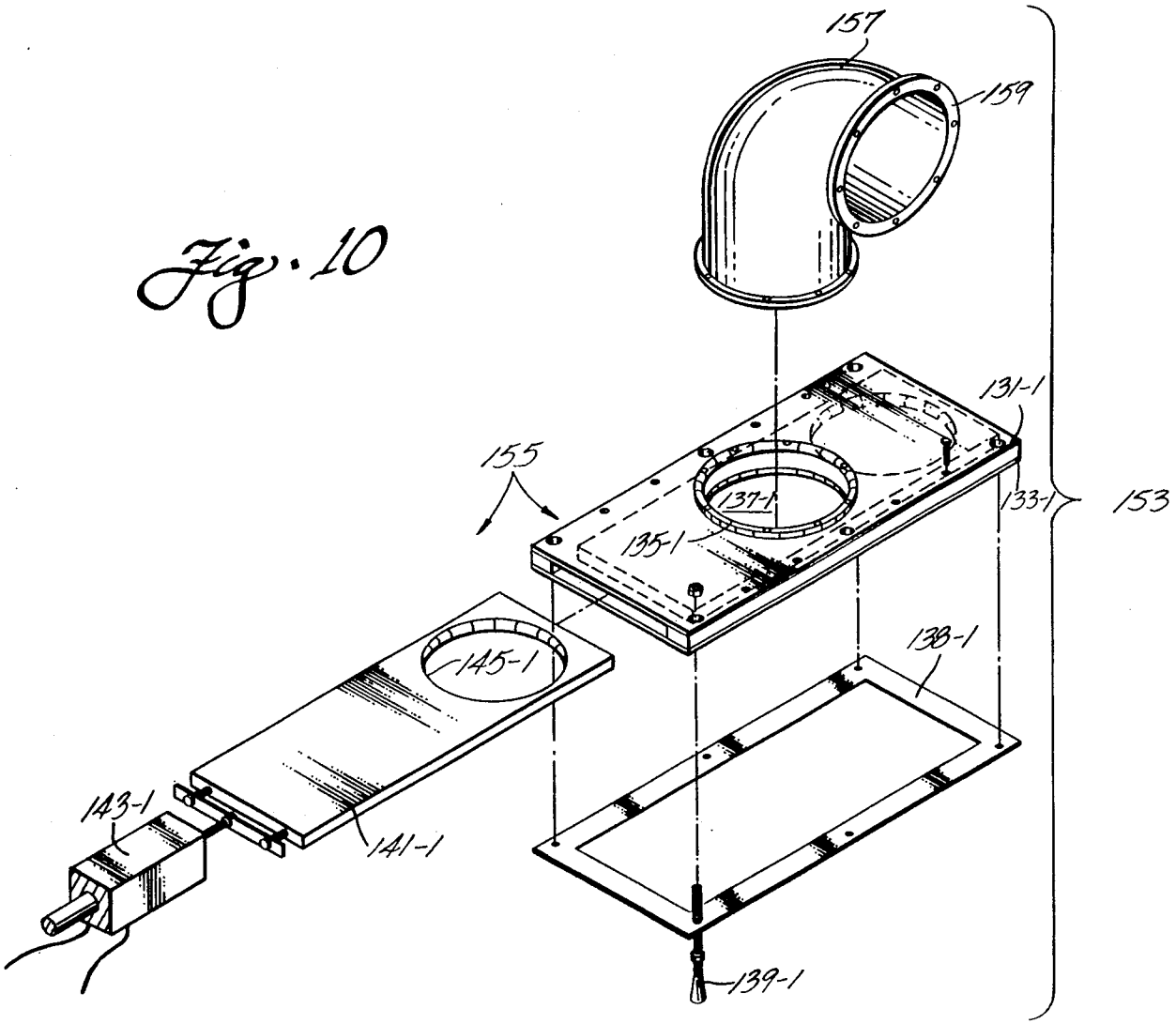
FIG. 10 is an exploded, perspective view of one of the air outlets of the water chamber shown in FIG. 5, the means for connecting that air outlet to one of the illustrated air chambers, and a valve for periodically opening and closing that outlet.

Turning next to the pneumatic connection between the water-lift chamber 25 and the last air chamber 105, the connection is provided by an air coupling 153, of which two are provided, one of them being a normally-inoperative (and closed) backup in the event that the primary coupling fails. As best seen in FIG. 10, the air coupling 153 is comprised of a rectangular opening in the led ge 69 (not visible in FIG. 5) and an air outlet valve assembly 155, which may be identical to the air inlet valve assembly 129 illustrated in FIG. 9. The air outlet valve assembly 155 is illustrated in FIG. 10, and, since its parts are identical to the components of the air inlet valve assembly 129, they are identified with the same reference numerals, but with a suffix "1" added. In place of the manifold 147, a coupling elbow 157 is bolted on top of the valve assembly 155, with the upper end 159 of the elbow 157 being bolted to an opening in the front wall 65, so as to enter the last air chamber 105.

The two stepper motors 143 and 143-1 are controlled (preferably, by electronic timing means not shown) so as to periodically open and close the air inlet 137 and the air outlet 137-1, synchronously, so that each is opened a fraction of a second after the other one is closed.

Summarizing the air flow through the water-lift chamber 25, when the air inlet valve assembly 129 is open, air is sucked from the atmosphere, through the manifolds and through the valve inlet opening 137, into the water-lift chamber 25, in which a vacuum of about 5 ft. has been developed during the preceding approximately 7 seconds. At this time, the valve assembly 155 will normally be closed, and the column of water will free-fall due to unrestricted air flow permitted by the size of the inlets 137. When the air inlet valve assembly 155 is closed and the air outlet valve assembly 129 is open, air is exhausted from the water-lift chamber 25, through the valve opening 137-1 and the elbow 157, into the last chamber 105, at a rate determined by the size of the air outlet valve opening 137-1 and the pressure differential between the pressure prevailing in the water-lift chamber 25 and the last air chamber 105. The air thus removed from the water-lift chamber 25 ultimately reaches the blower 23, after passing through the second and first air chambers 103 and 101, which it reaches through the openings 107 and the adjustable openings 109. To remove any water which might collect as a result of the air flow just described, a set of drain pipes 159 are embedded in the floor 61 and are connected with floor drains (not shown) in each of the three chambers 101, 103, and 105.

From the foregoing, it is apparent that there has been described a wave generator which is durable because of the minimum pressure fluctuations on its air blower and which is flexible by virtue of the adjustable openings which are provided between adjacent chambers, whereby the operating characteristics of the apparatus, and particularly, the relative pressures in its three chambers, may be altered.

What is claimed is:

1. A wave generator for periodically inducing surface waves in a body of water, comprising:
   (a) a water-lift elevator positioned next to said body of water and having:
      (i) a water-lift chamber rising above the surface of said body of water;
      (ii) an opening extending below the surface of said body of water for exchanging water between said water-lift chamber and said body of water;
      (iii) an air inlet for admitting air into said water-lift chamber; and
      (iv) an air outlet for exhausting air from said water-lift chamber;
   (b) pump means for exhausting air, said pump means having an air intake;
   (c) air buffer means for defining an enclosed air space connected between the air intake of said pump means for exhausting air and said air outlet; and
   (d) valve means for periodically opening and closing said air inlet and said air outlet so as to periodically raise and drop, in said water-lift chamber, water from said body of water.

2. The wave generator of claim 1, wherein said air buffer means comprises at least one air chamber whose volume is substantially equal to that of said water-lift chamber.

3. The wave generator of claim 1, wherein said air buffer means comprises a plurality of interconnected air chambers pneumatically connected serially between the pump air intake and the water elevator outlet.

4. The wave generator of claim 1, wherein said air buffer means comprises an integral structure having external walls defining an air-sealed space and at least one partition dividing said air-sealed space into separate chambers, said partition having an opening therein for pneumatically interconnecting said chambers serially.

5. The wave generator of claim 4, wherein said integral structure is linear and said partitions are at least two in number and are distributed along the length of said structure substantially parallel to one another to form a linear array of serially-interconnected chambers.

6. The wave generator of claim 4 additionally including said means for altering the size of said opening among predetermined values to alter the pneumatic characteristics of said air buffer means.

7. The wave generator of claim 6, wherein said altering means comprises:
   (a) a panel with at least one orifice therein smaller than said opening; and
   (b) means for affixing said panel to said partition so as to superimpose said orifice upon said opening.

8. The wave generator of claim 6, wherein said altering means comprises:
   (a) a panel with a plurality of differently-sized orifices, each smaller than said opening; and
   (b) means for slidably affixing said panel to said partition so as to superimpose a selected one of said orifices upon said opening in said partition.

9. The wave generator of claim 1, wherein:
   (a) said water-lift chamber extends linearly along the surface of said body of water; and (b) said air buffer means comprises an integral structure having external walls forming a linearly-extending sealed air space immediately adjacent said water-lift chamber.

10. The wave generator of claim 9, wherein said structure includes linearly-spaced-apart partitions separating said sealed air space into a plurality of serial chambers, said partitions having openings therein to allow limited air exchange between adjacent ones of said chambers.

11. A wave generator for periodically inducing surface waves in a body of water, comprising:

(a) a water-lift elevator positioned next to said body of water and having:

(i) a water-lift chamber rising above the surface of said body of water;

(ii) an opening extending below the surface of said body of water for exchanging water between said water-lift chamber and said body of water;

(iii) an air inlet for admitting air into said water-lift chamber; and (iv) an air outlet for exhausting air from said water-lift chamber;

(b) pump means for exhausting air, said pump means having an air intake;

(c) air buffer means for defining an enclosed air space connected between the air intake of said pump means for exhausting air and said air outlet, the air buffer means comprising a plurality of interconnected air chambers pneumatically connected serially between the pump air intake and the water-lift chamber air outlet, the air chambers including a first chamber pneumatically connected to said pump air intake, a last chamber pneumatically connected to said water chamber air outlet, and at least one intermediate chamber pneumatically connected between said first and last chambers; and (d) valve means for periodically opening and closing said air inlet and said air outlet so as to periodically raise and drop, in said water-lift chamber, water from said body of water.

12. A wave generator for periodically inducing surface waves in a body of water, comprising:

(a) a water-lift elevator positioned next to said body of water and having:

(i) a water-lift chamber rising above the surface of said body of water;

(ii) an opening extending below the surface of said body of water for exchanging water between said water-lift chamber and said body of water;

(iii) an air inlet for admitting air into said water-lift chamber; and (iv) an air outlet for exhausting air from said water-lift chamber;

(b) pump means for exhausting air, said pump means having an air intake;

(c) air buffer means for defining an enclosed air space connected between the air intake of said pump means for exhausting air and said air outlet, the air buffer means comprising a plurality of interconnected air chambers pneumatically connected serially between the pump air intake and the water-lift chamber air outlet, the air chambers including a first chamber pneumatically connected to said pump air intake, a last chamber pneumatically connected to said water chamber air outlet, and at least one intermediate chamber pneumatically connected between said first and last chambers, the air chambers having substantially equal volumes, the volume of each being at least approximately that of said water-lift chamber; and (d) valve means for periodically opening and closing said air inlet and said air outlet so as to periodically raise and drop, in said water-lift chamber, water from said body of water.

13. In combination with a basin holding a body of water, a wave generator adjacent said basin comprising:

(a) means for elevating water into a column, said means having:

(i) a water-lift chamber having a water-discharge opening, said opening extending below the surface of said body of water;

(ii) an air inlet into said water-lift chamber, open to the atmosphere; and (iii) an air outlet from said water-lift chamber;

(b) pump means, having an intake, for exhausting air through said intake;

(c) air buffer means, having a plurality of serially arranged pneumatically connected air chambers, connecting the intake of said exhausting means to said water-lift-chamber outlet, for providing an air passage between said water-lift chamber and said pump means while buffering said pump means from air pressure fluctuations in said water-lift chamber; and (d) means for periodically opening and sealing said inlet and said outlet so as to periodically exhaust air from and supply air to said water-lift chamber, thereby periodically lifting and dropping a column of water therein.

14. The wave generator of claim 13, wherein:

(a) said water-lift chamber extends linearly along the surface of said body of water; and (b) said buffer means comprises an integral structure having external walls forming a linearly-extending sealed air space immediately adjacent said water-lift chamber.

15. The wave generator of claim 13, wherein said water-lift chamber and said air buffer means share a common wall.

16. In combination with a basin holding a body of water, a wave generator adjacent said basin comprising:

(a) means for elevating water into a column, said means having:

(i) a water-lift chamber having a water-discharge opening, said opening extending below the surface of said body of water;

(ii) an air inlet into said water-lift chamber, open to the atmosphere; and (iii) an air outlet from said water-lift chamber;

(b) pump means, having an intake, for exhausting air through said intake;

(c) air buffer means, having a plurality of serially arranged pneumatically connected air chambers, connecting the intake of said exhausting means to said water-lift-chamber outlet, for providing an air passage between said water-lift chamber and said pump means while buffering said pump means from air pressure fluctuations in said water-lift chamber, the air buffer means comprising an integral structure having external walls defining an air-sealed space and a plurality of partitions dividing said air-sealed space into said chambers, each partition having an opening therein for porting adjacent chambers; and (d) means for periodically opening and sealing said inlet and said outlet so as to periodically exhaust air from and supply air to said water-lift chamber, thereby periodically lifting and dropping a column of water therein.

17. The wave generator of claim 16 additionally including means for altering the size of said openings so as to alter the pneumatic characteristics of said buffer means.

18. The wave generator of claim 17, wherein said altering means comprises:

(a) a panel with at least one orifice therein smaller than said opening; and (b) means for affixing said panel to said partition so as to superimpose said orifice upon said opening.

19. In combination with a basin holding a body of water, a wave generator adjacent said basin comprising:

(a) means for elevating water into a column, said means having:

(i) a water-lift chamber having a water-discharge opening, said opening extending below the surface of said body of water;

(ii) an air inlet into said water-lift chamber, open to the atmosphere; and (iii) an air outlet from said water-lift chamber;

(b) pump means, having an intake, for exhausting air through said intake;

(c) air buffer means, having a series of pneumatically interconnected air chambers, connecting the intake of said exhausting means to said water-lift chamber outlet, for providing an air passage between said water-lift chamber and said pump means while buffering said pump means from air pressure fluctuations in said water-lift chamber, the air buffer means sharing a common wall with aid water-lift chamber, the air buffer means comprising a series of pneumatically interconnected chambers, a first and a last one of said chambers being pneumatically connected to said pump means intake and to said water-lift chamber air outlet, respectively; and (d) means for periodically opening and sealing said inlet and said outlet so as to periodically exhaust air from and supply air to said water-lift chamber, thereby periodically lifting and dropping a column of water therein.

20. The wave generator of claim 19, wherein said air buffer means comprises a unitary, elongate housing and said series of chambers are formed in said housing by partitions spaced apart along the length of said housing, said partitions having apertures therein.

21. The wave generator of claim 20, wherein said apertures are individually adjustable in size.

22. The wave generator of claim 20, wherein said water-lift chamber includes:

(a) a cantilevered wall extending parallel to said common wall to form therewith an elongate chamber having a cross-section in the shape of an inverted "U"' and (b) a plurality of reinforcing panels spaced apart along the length of said elongate water-lift chamber between said common wall and said cantilevered wall.

23. The wave generator of claim 22, wherein said spaced-apart partitions in said buffer means are aligned with the spaced-apart reinforcing panels in said water-lift chamber.

24. A wave generator for inducing surface waves in a body of water, comprising:

(a) a water-lift elevator positioned next to said body of water and having:

(i) a water-lift chamber rising above the surface of said body of water;

(ii) an opening for exchanging water between said water-lift chamber and said body of water; and (iii) an air outlet for exhausting air from said water-lift chamber;

(b) means for exhausting air;

(c) air buffer means for defining an enclosed air space connected between said means for exhausting air and said air outlet; and (d) valve means for periodically opening and closing said air outlet so as to periodically raise and drop, in said water-lift chamber, water from said body of water.

25. The wave generator of claim 24, wherein said air buffer means comprises at least one air chamber whose volume is substantially equal to that of said water-lift chamber.

26. The wave generator of claim 24, wherein said air buffer means comprises a plurality of serially arranged air chambers pneumatically connected between the pump air intake and the water elevator air outlet.

27. The wave generator of claim 24, wherein:

(a) said water-lift chamber extends linearly along the surface of said body of water; and (b) said air buffer means comprises an integral structure having external walls forming a linearly-extending sealed air space immediately adjacent said water-lift chamber.

28. A wave generator for inducing surface waves in a body of water, comprising:

(a) a water-lift elevator positioned next to said body of water and having:

(i) a water-lift chamber rising above the surface of said body of water;

(ii) an opening for exchanging water between said water-lift chamber and said body of water; and (iii) an air outlet for exhausting air from said water-lift chamber;

(b) means for exhausting air;

(c) air buffer means for defining an enclosed air space connected between said means for exhausting air and said air outlet, the air buffer comprising a plurality of serially arranged air chambers pneumatically connected between the pump air intake and the water elevator air outlet, the air chambers including a first chamber pneumatically connected to said pump air intake, a last chamber pneumatically connected to said water chamber air outlet, and at least one intermediate chamber pneumatically connected between said first and last chambers; and (d) valve means for periodically opening and closing said air outlet so as to periodically raise and drop, in said water-lift chamber, water from said body of water.

* * * * *